US005438177A

United States Patent [19]

Fagan

[11] Patent Number: 5,438,177

[45] Date of Patent: Aug. 1, 1995

[54] TWO-LAYER MEMBRANE SWITCH

[75] Inventor: Mark W. Fagan, El Paso, Tex.

[73] Assignee: Key Tronic Corporation, Spokane, Wash.

[21] Appl. No.: 879,666

[22] Filed: May 6, 1992

[51] Int. Cl.[6] ..... H01H 1/10

[52] U.S. Cl. ..... 200/517; 200/512; 200/520; 200/5 A

[58] Field of Search ..... 200/517, 512, 513, 514, 200/515, 516, 520, 239, 243, 5 A, 5 R, 511

[56] References Cited

U.S. PATENT DOCUMENTS

| | | | |
|---|---|---|---|
| 3,721,778 | 3/1973 | Seeger, Jr. et al. | 200/5 R |
| 3,996,427 | 12/1976 | Kaminski | 200/517 |
| 4,341,934 | 7/1982 | Muller | 200/517 |
| 4,794,215 | 12/1988 | Sawada et al. | 200/512 |
| 5,115,106 | 5/1992 | Weiland et al. | 200/512 |

OTHER PUBLICATIONS

"Electronic Keyboard," A. L. Akers & G. T. Williams, IBM Technical Disclosure Bulletin, vol. 25, No. 11B, Apr. 1983.

*Primary Examiner*—Robert M. Fetsuga
*Assistant Examiner*—David T. Walczak
*Attorney, Agent, or Firm*—Wells, St. John, Roberts, Gregory & Matkin

[57] ABSTRACT

A two-layer membrane switch particularly suited for application as a keyswitch in low-profile keyboard applications, such as keyboards for notebook or laptop type personal computers. When used as a keyswitch, the switch comprises a first conductor layer including a conductive ink patterned as an electrical contact on a polyester dielectric film around an opening through the film. A second conductor layer, also includes a conductive ink patterned as an electrical contact on a polyester dielectric film. With the electrical contact of the second conductor layer located under the corresponding opening in the first conductor layer, a moveable, conductive elastomer switch closure is used to establish electrical contact between the electrical contact of the first conductor layer and the electrical contact of the second conductor layer through the opening in the first conductor.

12 Claims, 7 Drawing Sheets

TWO-LAYER MEMBRANE SWITCH

BACKGROUND OF THE INVENTION

This invention is directed to a new two-layer membrane switch. This switch may be used to define keyswitches for use in keyboards, particularly keyboards where a low keyswitch profile is desirable.

In particular, this invention utilizes two conductive membranes of a type commonly used in membrane keyboards and other applications, in combination with a conductive elastomeric contact, wherein the elastomeric contact is used to contact predefined areas on each of the two conductive membrane layers, thereby providing a circuit path between these layers and defining a switch. In this switch configuration, the conductive portions on both membrane layers are aligned in the same direction. The result is that these membranes can be stacked directly on top of one another without the need for a separate dielectric spacer.

In related art, contact-type membrane switches have been utilized which have two conductive layers as illustrated in FIG. 1. In FIG. 1, there are two conductive membranes, conductive membrane 2 and conductive membrane 4. Each membrane has a conductor attached to one surface, conductor 6 and conductor 8 respectively. Conductive membrane 2 and conductive membrane 4 are separated by a dielectric spacer 10. Switch contact is made by applying a downward force on one of the conductive membranes; in this illustration, conductive membrane 2. This force can be applied in a number of ways. When such switches are used in keyboard applications the force is typically applied via a keystem 12, passing through keystem guide 14. Keystem 12 is typically attached to a keycap, and is actuated by a user depressing the keycap associated with keystem 12 with his finger. Upon actuation, conductor 6 and conductor 8 contact one another, thereby completing an electrical circuit between them. If conductor 6 and conductor 8 are connected to sense and drive circuitry of a type known in the art, the result is a sensed switch output or closure.

The switch structure illustrated in FIG. 1 has been shown to provide reliable switch contacts in keyboard applications, however, this structure also has a number of associated disadvantages.

A first disadvantage has to do with the cost of dielectric spacer 10. Dielectric spacer 10 has both a material cost for the dielectric material, and a cost to assemble the dielectric spacer into the switch configuration, such as in a keyboard assembly.

A second disadvantage associated with the switch structure illustrated in FIG. 1 has to do with limitations imposed on the switch structure by keystem guide 14. In related art keyboards, a plurality of keystem guides 14 are provided on a housing sheet 16. Housing sheet 16 and keystem guides 14 require a certain thickness for implementation, particularly the thickness of housing sheet 16. However, in certain applications, such as keyboards having a low keyswitch profile, it is desirable to minimize the amount of travel necessary for keyswitch actuation. In such applications, it is desirable to eliminate travel constraints, such as those imposed by the thickness of housing sheet 16, while retaining the function of keystem guides 14. One way to accomplish this is to incorporate keystem guides into the base. However, such a keystem guide configuration is not readily adaptable to a switch configuration of the type illustrated in FIG. 1, because of the necessity of keystem guide 14 protruding through membrane 2 and membrane 4.

A third disadvantage associated with the switch structure illustrated in FIG. 1 is that the structure creates a closed space 20 which can cause instability in membranes 2 and 4 in the regions adjacent to closed space 20 when the switch is exposed to varying temperature and humidity conditions. Such instability can affect the performance of switches of this type.

SUMMARY OF THE INVENTION

In the present invention, the disadvantages of previous membrane switches utilizing two conductive layers have been solved. In the present invention, the conductive membrane layers are positioned such that the conductive portions of these layers are oriented in the same direction, as an upper and lower conductive membrane. In this configuration, dielectric isolation is provided by the membrane material itself which includes a dielectric substrate to which the conductor is attached. Electrical contact between the layers, which forms the basis for switch actuation, is provided by utilizing openings in the upper conductive membrane in the areas where it is desirable to form the switch. An electrical contact is provided in the conductive portion of the upper conductive membrane, adjacent to the opening. An electrical contact is also provided in the conductor of the lower conductive membrane, such that the electrical contact on the lower conductive membrane is located under the opening provided in the upper conductive membrane. Switch closure is provided by a moveable switch closure means, such as a conductor which can be moved so as to contact both the electrical contact on the upper membrane and the electrical contact on the lower membrane. In a preferred embodiment, the switch closure means comprises a conductive elastomeric ring which can be attached to an elastomeric dome of a type commonly used in membrane keyboards. Upon actuation of a keycap, the elastomeric dome is compressed, forcing the conductive elastomeric ring into contact with the electrical contacts located on the upper and lower conductive membranes. The elastomeric ring passes through the opening in the upper conductive membrane in order to contact the electrical contact on the lower conductive membrane, thereby providing a switch output.

The membrane switch of the present invention provides distinct advantages over the previous membrane switches which utilize two conductive layers as illustrated in FIG. 1. First, the switch structure of the present invention does not incorporate a dielectric spacer, such that the cost of materials for and cost of assembling such spacer are eliminated.

Secondly, the configuration of the switch of the present invention allows its application in keyboards, where it can be used with a keystem guide which protrudes through the switch from a base under the switch. This eliminates the necessity of having a housing sheet to provide the keystem guides, thereby reducing overall key travel required to actuate the switch, and hence its profile.

A third advantage of the present invention is that it does not have open spaces between the conductive membranes in the region defining the switch contacts. Therefore, these switches should be significantly less susceptible to instability caused by variations in temperature and humidity.

These advantages make the two-layer membrane switch structure of the present invention particularly desirable for low-profile keyboard applications. Other objects, features and advantages of the present invention may be realized by those skilled in the art upon review of the drawings and description of the preferred embodiment provided below.

FIG. *2a* is a plan view of a two-layer membrane switch of the present invention.

FIG. *2b* is a cross-sectional view of a two-layer membrane switch of the present invention.

FIG. *3a* is a keyswitch incorporating a two-layer membrane switch of the present invention, shown in the open position.

FIG. *3b* is a keyswitch incorporating a two-layer membrane switch of the present invention, shown in the closed position.

Figure 1:
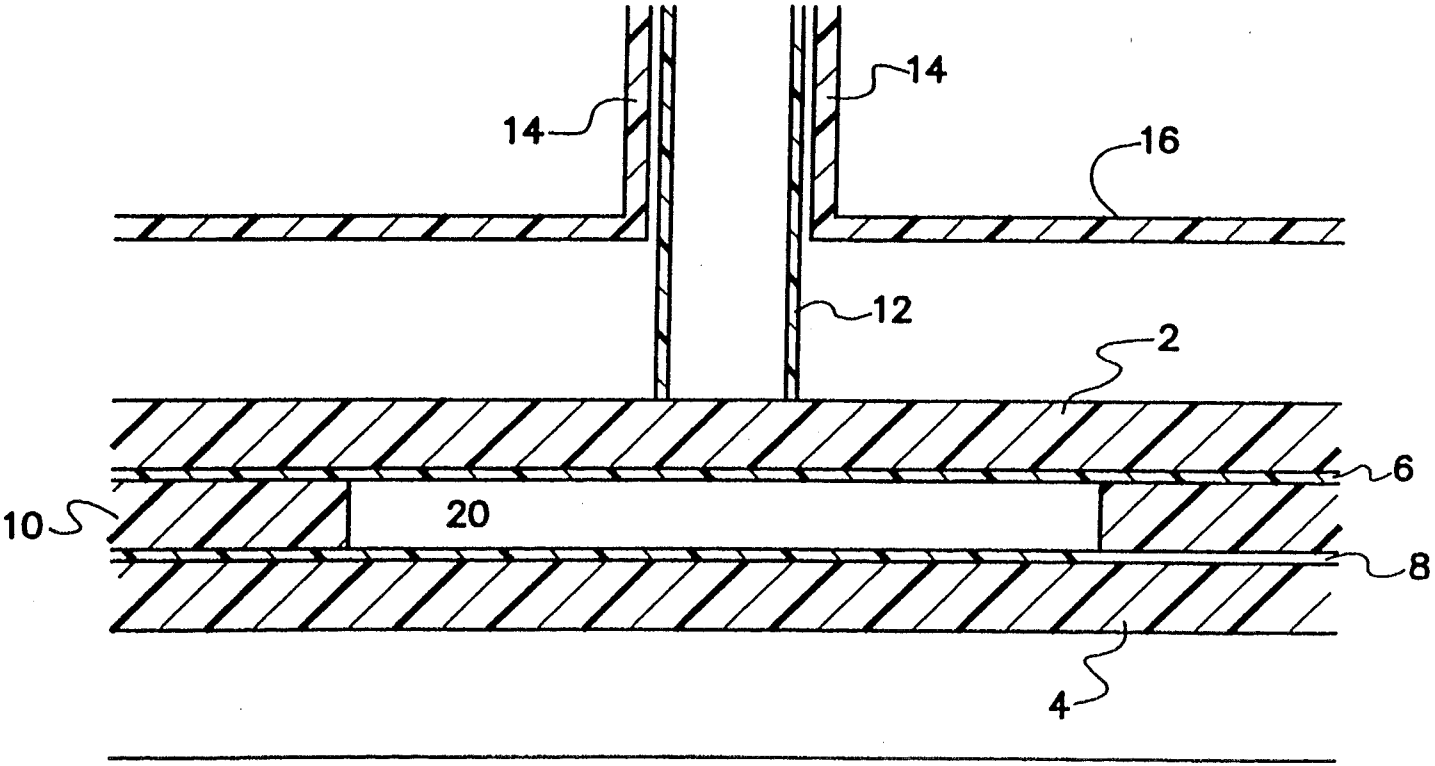
PRIOR ART Fig. 1
FIG. 1 is a cross-section of a related art two-layer contact membrane switch.
Figure 2A:
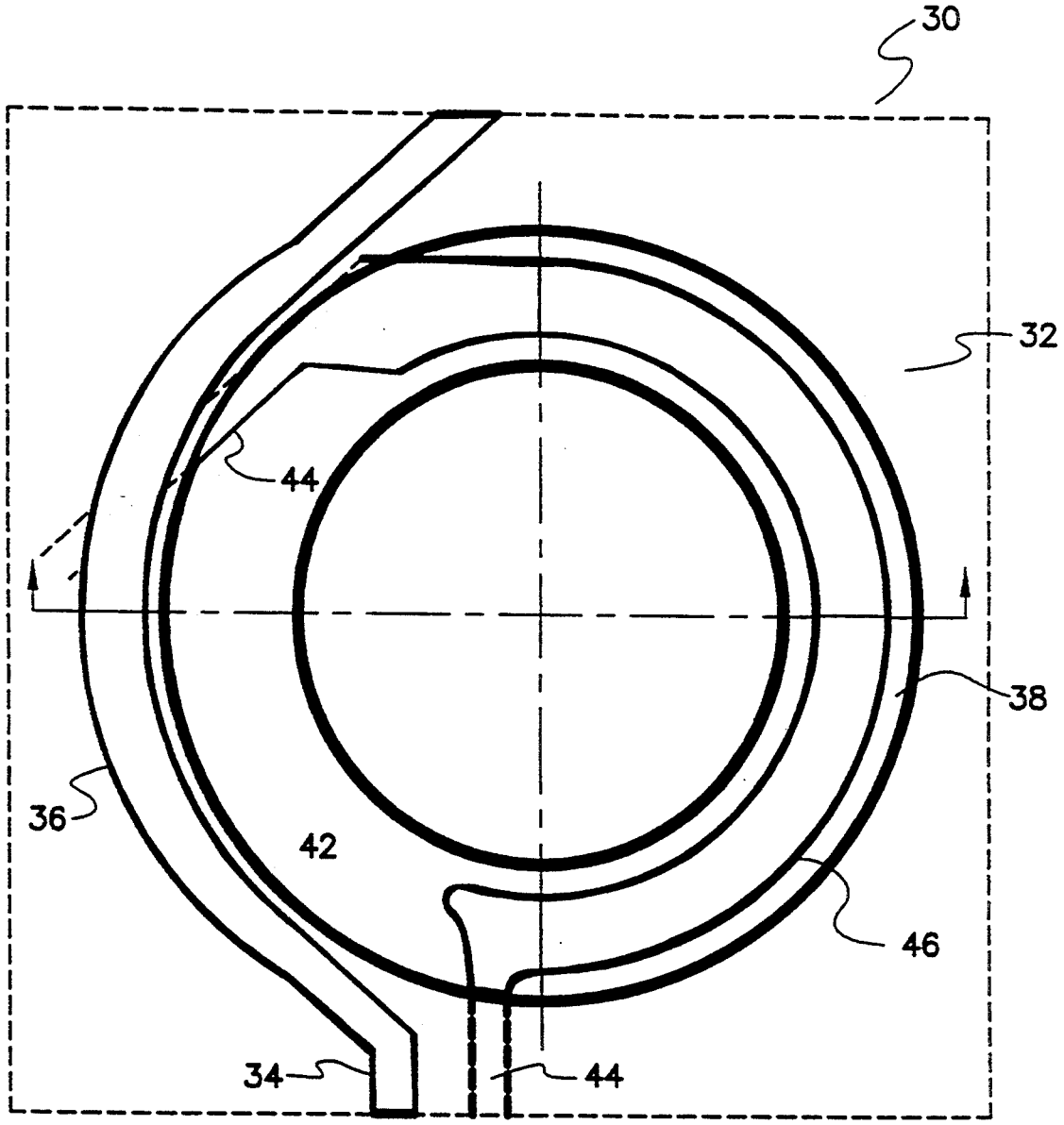
Figure 2B:
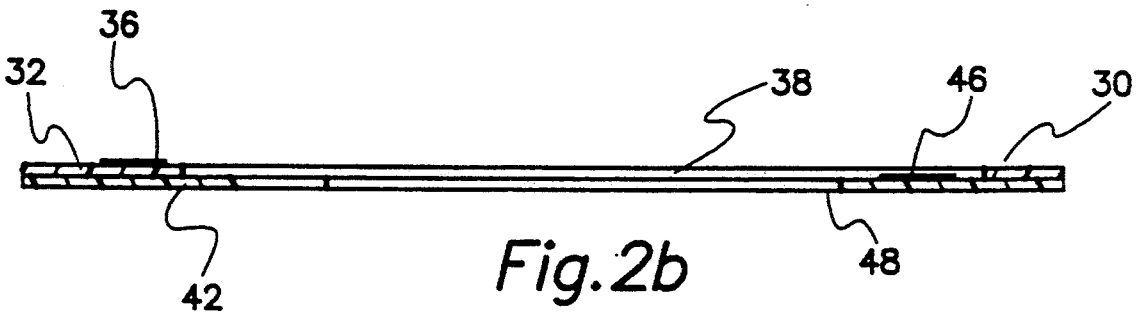
Figure 3A:
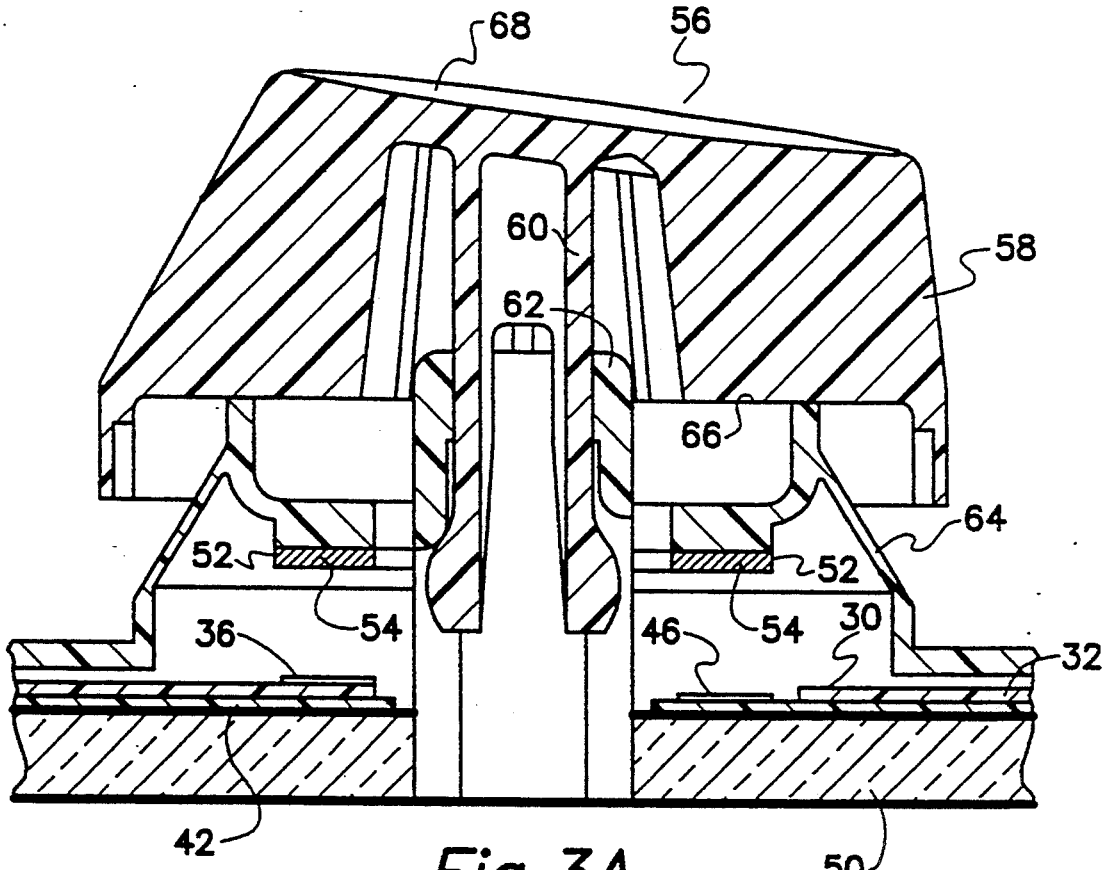
Figure 3B:
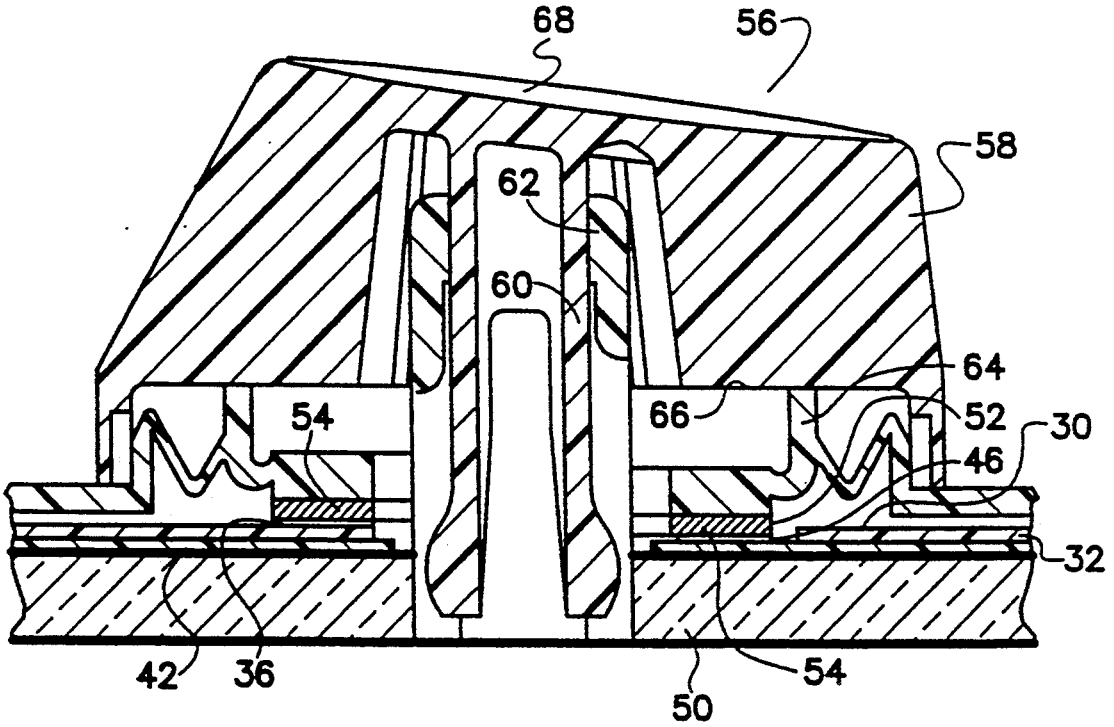
Figure 4:
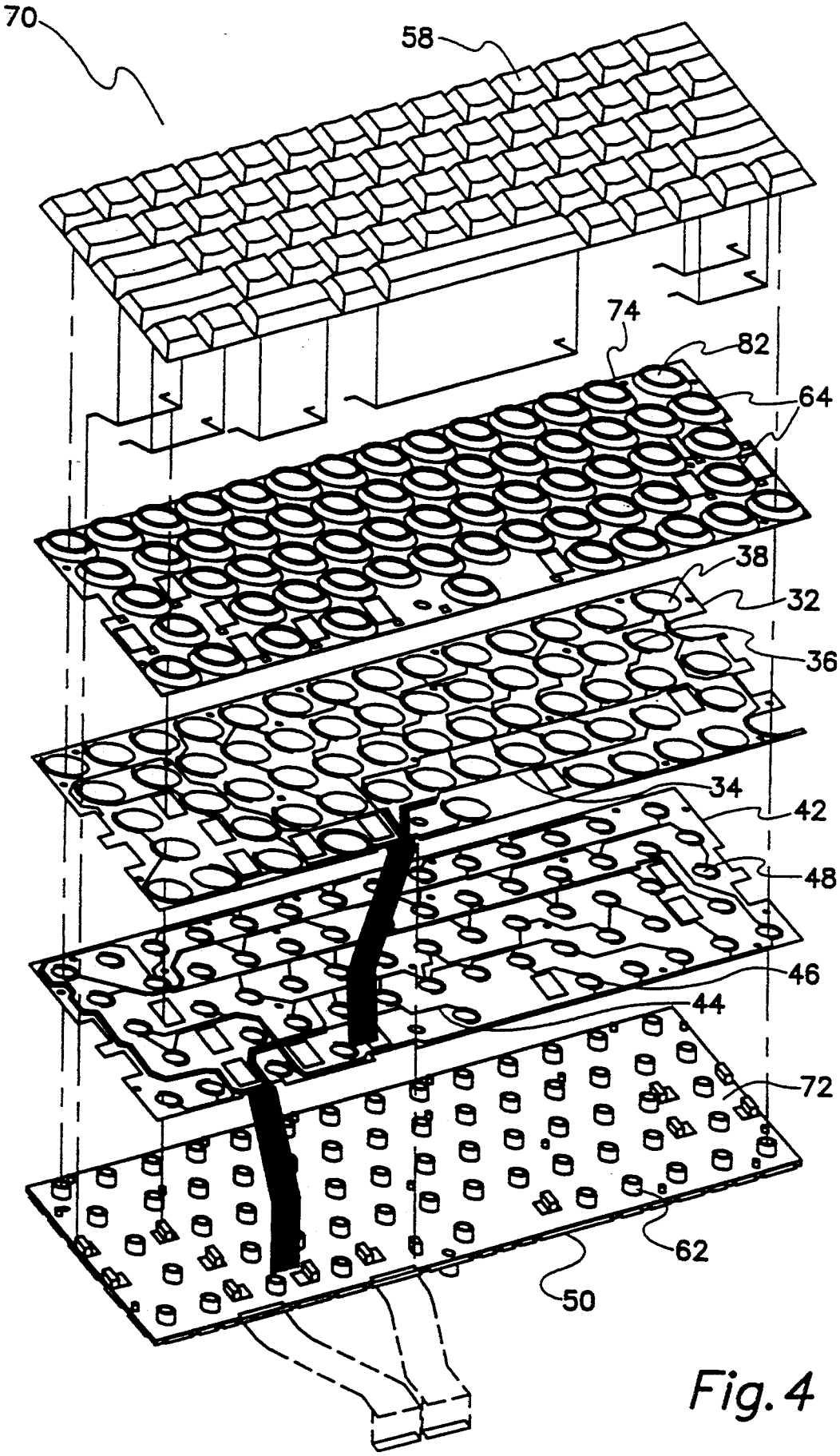

FIG. 4 is an exploded view of a keyboard incorporating a plurality of two-layer membrane switches of the present invention.

Figure 5:
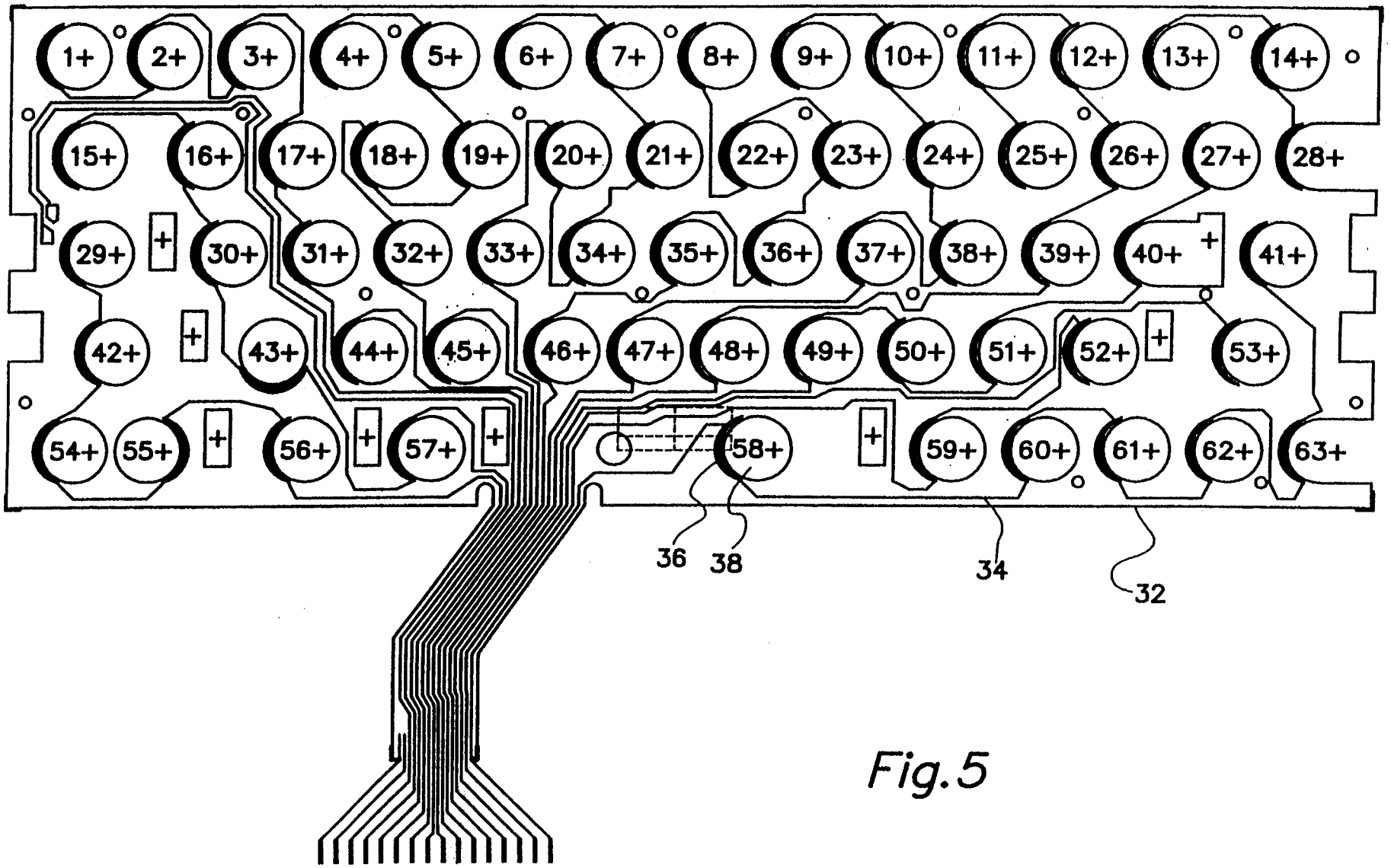

FIG. 5 is a plan view of an upper membrane for a keyboard incorporating a plurality of electrical contacts.

Figure 6:
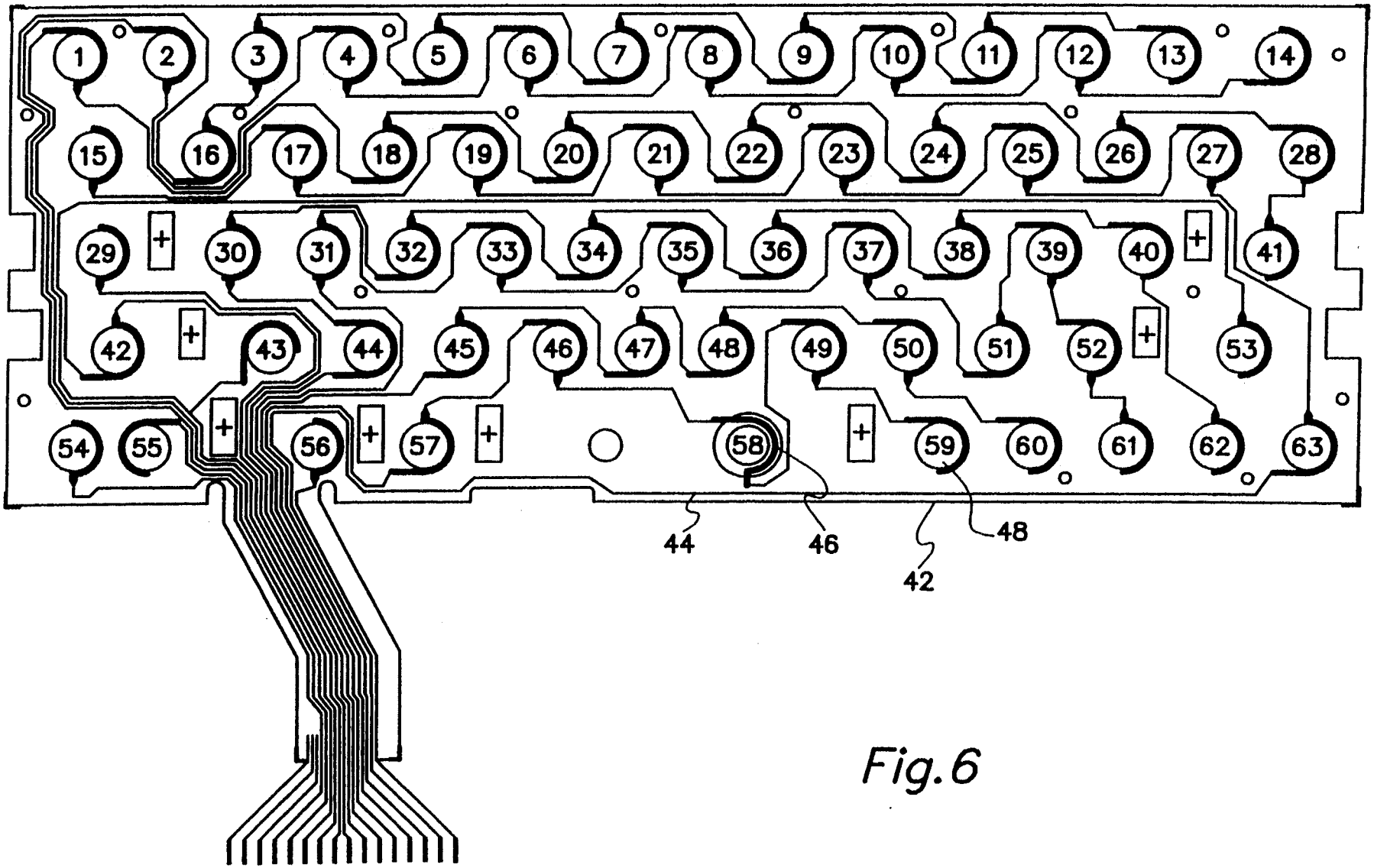
Figure 7A:
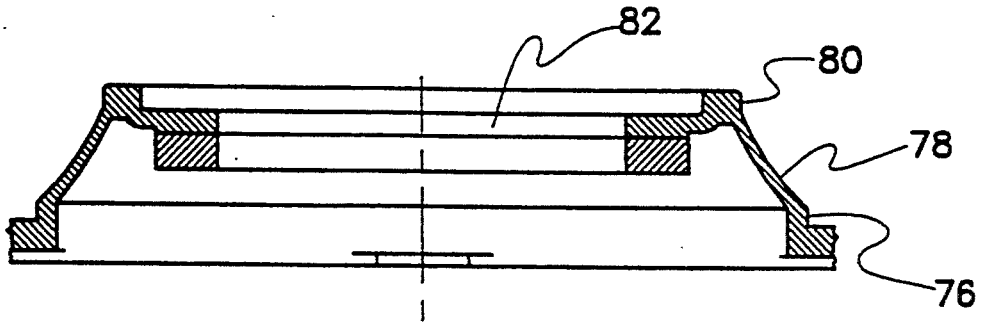
Figure 7B:
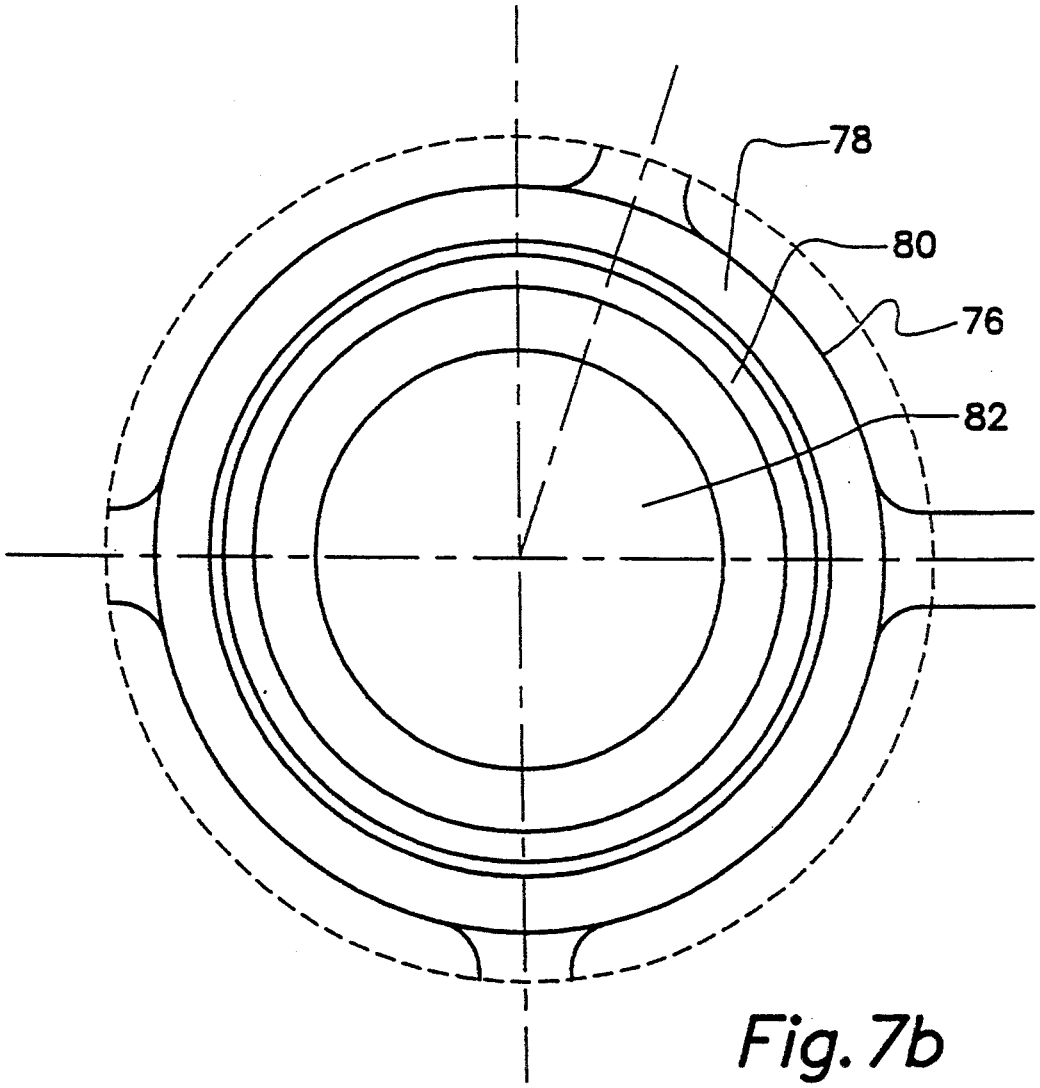

FIG. 6 is a plan view of the lower membrane for a keyboard incorporating a plurality of electrical contacts.

FIG. *7a* is a cross-section of an elastomeric dome.

FIG. *7b* is a plan view of the elastomeric dome of FIG. *7a*.

DETAILED DESCRIPTION OF THE PREFERRED EMBODIMENT

The present invention comprises a two-layer, contact-type membrane switch suitable for use in keyboard applications, as described in FIGS. *2a* and *2b*. Membrane switch 30 includes an upper membrane 32 having a conductor 34 and an electrical contact 36 formed in conductor 34. In a preferred embodiment, upper membrane 32 also includes an opening 38 which extends all the way through upper membrane 32. In a preferred embodiment, upper membrane 32 is a polyester sheet of a type commonly used in membrane switches with a thickness of approximately 0.003 inches. Conductor 34 can be deposited on upper membrane 32 using screen printing, or a similar deposition technique of a conductive ink, to a thickness on the order of 0.0003 to 0.008 inches. The resistivity of conductor 34 is on the order of 15 milliohms per square per mil.

Referring again to FIGS. *2a* and *2b*, membrane switch 30 also includes lower membrane 42, having a conductor 44 and an electrical contact 46 formed in conductor 44. In a preferred embodiment, lower membrane 42 also includes an opening 48 which extends entirely through lower membrane 42. In a preferred embodiment, the construction of upper membrane 32 and lower membrane 42 are similar, including the materials used for conductor 34 and conductor 44 respectively.

To create membrane switch 30, upper membrane 32 is placed over lower membrane 42, such that conductor 36 and conductor 46 are both facing in the same direction. In the preferred embodiment, conductor 36 and conductor 46 are facing upwardly away from a base 50 on which they are resting, as illustrated in FIGS. *3a* and *3b*.

Referring now to FIGS. *2a*, *2b*, *3a* and *3b*, membrane switch 30 must also include a means for providing switch closure 52. In a simple form, this requires being able to open and close a conductive path between electrical contact 36 and electrical contact 46. In a preferred embodiment, this can be provided by a moveable electrical contact in the form of conductive ring 54 which can be moved so as to alternately make and break electrical contact with electrical contacts 36 and 46. Conductive ring 54 is positioned above electrical contact 36 and electrical contact 46, and is in moveable relation with both contacts such that it can be used to make and break contact with each of them at the same time, thereby serving as a switch between conductor 34 and conductor 44. The shape and location of electrical contacts 36 and 46 can be altered so that they are aligned to a moveable electrical contact having a different shape. Likewise, the shape of the moveable electrical contact can be altered to accommodate the size and position of the electrical contacts.

Referring now to FIGS. *3a*, *3b* and 4 as a preferred embodiment, the incorporation of membrane switch 30 into keyswitch 56 is illustrated. In a preferred embodiment, keyswitch 56 includes keycap 58 having generally cylindrical keystem 60 which is adapted to be inserted into and held in movable relation with a generally cylindrical keyguide 62, which is attached to a base 50. An elastomeric dome 64 is interposed between the lower surface 66 of keycap 58 and membrane switch 30. Elastomeric dome 64 is of a design and material (e.g. EPDM or silicone) known in the art, having cylindrical lower portion 76, frusto-conical mid-portion 78, cylindrical cap 80 and opening 82 extending through cylindrical cap 80 as illustrated in FIGS. *7a* and *7b*. Elastomeric dome 64 is elastically compressible, and can be used as shown in FIGS. *3a* to bias membrane switch 30 in a generally open position; subject to closure upon compression of elastomeric dome 64, as shown in FIG. *3b*. In a preferred embodiment, elastomeric dome 64 has conductive ring 54 attached to the interior of the dome. Elastomeric dome 64, conductive ring 54 and membrane switch 30 are positioned such that conductive ring 54 is over electrical contact 36 and electrical contact 46. In a preferred embodiment, conductive ring 54 can include a conductive elastomeric ring.

In order to actuate keyswitch 56, it is necessary to close switch closure means 52. This can be done by an operator pressing downwardly on top surface 68 of keycap 56. As shown in FIG. *3b*, such an action will cause elastomeric dome 64 to be compressed and will bring conductive ring 54 into contact with electrical contact 36 and electrical contact 46, thus providing closure of keyswitch 56 by providing closure of membrane switch 30. By releasing keyswitch 56, elastomeric dome 64 will resume the shape shown in FIG. *3a*, and move keycap 58 outwardly away from base 50. Conductive ring 54 will move out of contact with electrical contact 36 and electrical contact 46, thereby opening keyswitch 56, and thus membrane switch 30.

FIGS. 4, 5 and 6 illustrate the incorporation of a plurality of keyswitches 56 into a keyboard 70. Keyboard 70 includes a base 50 having a plurality of upwardly extending cylindrical keyguides 62. Lower membrane 42, with conductor 44 facing upwardly, is placed on upper surface 72 of base 50, with keyguides 62 extending upwardly through a plurality of openings 48. Upper membrane 32, with upwardly facing conductor 34, is then placed on top of lower membrane 42, such that keyguides 62 also extend upwardly through openings 38. A plurality of elastomeric domes 64 is then placed via plurality of openings 82 over keyguides 62. In a preferred embodiment, the plurality of elastomeric domes 64 can comprise an elastomeric sheet 74 containing the plurality of elastomeric domes 64. Finally, a plurality of keycaps 58 are inserted into and movably engaged with and held in keyguides 62.

The result is a contact keyboard 70 having a lower keyswitch profile than related art keyboards which incorporate contact keyswitches. Such low-profile keyboards have particular applicability for notebook personal computers, and other keyboard applications where the amount of travel of keyswitch 56 is limited to an amount less than the amount required to operate related art contact-style keyboards. Further description of a preferred embodiment of keyswitch 56 and keyboard 70 utilizing a capacitance-type membrane switch, rather than contact-type membrane switch 30 of the present invention, is set forth in co-pending, co-owned U.S. patent application Ser. No. 07/670,508, filing date Mar. 15, 1991, which is a file-wrapper continuation of U.S. patent application Ser. No. 07/511,493, filing date Apr. 20, 1990, which is hereby incorporated by reference.

The present invention is not limited to the foregoing description of a preferred embodiment illustrating membrane switches. It can also include the use of other non-flexible dielectric layer/conductor combinations in place of conductive membranes, as well as other possible combinations of materials.

I claim:

1. An electrical switch, comprising:

a first conductor attached to a top surface of a first dielectric substrate and adjacent to an opening in the first dielectric substrate;

a second conductor attached to a top surface of a second dielectric substrate, said second conductor positioned below the first dielectric substrate such that a portion of said second conductor is located under the opening in the first dielectric substrate;

means for opening and closing an electrical conduction path between said first conductor and said second conductor comprising a movable conductive contact located directly above said first conductor and said second conductor, wherein said moveable conductive contact may be moved to contact said first conductor and said second conductor by extending through the opening in the first dielectric substrate, thereby acting as a conductive path between said first and second conductors; and wherein said moveable electrical contact is located above said first and second conductors by attachment to a biased spring located above said conductors.

2. The electrical switch of claim 1 wherein the first dielectric substrate comprised a flexible dielectric layer.

3. The electrical switch of claim 2, wherein the flexible dielectric layer comprises a polyester membrane.

4. The electrical switch of claim 3, wherein said first conductor comprises a conductive ink.

5. The electrical switch of claim 1 wherein said second conductor comprises a conductive ink.

6. The electrical switch of claim 5, wherein the second dielectric substrate comprises a flexible dielectric layer.

7. The electrical switch of claim 6, wherein the flexible dielectric layer comprises a polyester membrane.

8. The electrical switch of claim 1, wherein the biased spring comprises an elastomeric dome.

9. An electrical switch, comprising:

a first conductor located on a top surface of a polyester film adjacent to an opening in said film;

a second conductor located on a top surface of a dielectric substrate; said second conductor positioned below the polyester film such that a portion of said second conductor is located under the opening in the polyester film;

means for opening and closing an electrical conduction path between said first conductor and said second conductor; and wherein said means for opening and closing an electrical conduction path comprises a conductive elastomeric contact biased by a spring directly above said first conductor and said second conductor, wherein said moveable conductive elastomeric contact may be moved to contact said first conductor and said second conductor by compressing the spring and moving the moveable conductive elastomeric contact into electrical contact with said first and second conductors, thereby acting as a conductive path between said first and second conductors.

10. A keyboard, comprising:

a first conductor means having a plurality of first electrical contacts each adjacent to an opening through said first conductor means and defining a keyswitch location;

a second conductor means having a plurality of second electrical contacts each corresponding to one of the keyswitch locations defined on said first conductor means, said second conductor means located under and in contact with said first conductor means such that each of the plurality of second electrical contacts on said second conductor means are aligned under the openings in said first conductor means;

a switch closure means having a plurality of moveable conductive switch closures corresponding to the keyswitch locations defined on said first conductor means, said switch closure means located above said first conductor means such that each of the plurality of moveable conductive switch closures can be moved so as to provide a conduction path between one of the first electrical contacts and one of the second electrical contacts;

wherein said first conductor means comprises a conductive ink deposited in a pattern on a top surface of a polyester dielectric film, such that the pattern defines the plurality of first electrical contacts adjacent to the openings defining the keyswitch locations;

wherein said second conductor means comprises a conductive ink deposited in a pattern on a top surface of a polyester dielectric film, such that the pattern defines the plurality of second electrical contacts; and wherein said switch closure means comprises an elastomeric sheet having a plurality of truncated, generally frusto-conical, elastomeric domes, each directed away from said first conductor means and containing the moveable conductive switch closures, such that each of the elastomeric domes can be compressed to move the moveable conductive switch closures into contact with the first and second electrical contacts.

11. The keyboard of claim 10, wherein at least one of the truncated, generally frusto-conical, elastomeric domes has a cylindrical portion at the truncated end adapted to receive one of the moveable conductive switch closures.

12. A keyboard having a plurality of keyswitches, at least one of the keyswitches comprising:

a first conductor located on a top surface of a polyester film adjacent to an opening in said firm;

a second conductor located on a top surface of a dielectric substrate; said second conductor positioned below the polyester film such that a portion of said second conductor is located under the opening in the polyester film;

means for opening and closing an electrical conduction path between said first conductor and said second conductor; and wherein said means for opening and closing an electrical conduction path comprises a conductive elastomeric contact biased by an elastomeric spring directly above said first conductor and said second conductor, wherein said moveable conductive elastomeric contact may be moved into contact with said first conductor and said second conductor by compressing the elastomeric spring.

* * * * *